US006793113B2

(12) United States Patent
Chakraborty et al.

(10) Patent No.: US 6,793,113 B2
(45) Date of Patent: Sep. 21, 2004

(54) UNIVERSAL AND PRECISE STAPLING METHOD AND APPARATUS

(75) Inventors: Amalesh Chakraborty, Mississauga (CA); Raymond Ruthenberg, Toronto (CA)

(73) Assignee: Xerox Corporation, Stamford, CT (US)

( * ) Notice: Subject to any disclaimer, the term of this patent is extended or adjusted under 35 U.S.C. 154(b) by 313 days.

(21) Appl. No.: 10/006,235

(22) Filed: Dec. 10, 2001

(65) Prior Publication Data

US 2003/0116600 A1 Jun. 26, 2003

(51) Int. Cl.[7] ..... B65H 39/10

(52) U.S. Cl. ..... 227/2; 227/6; 227/5; 270/37; 270/58.01; 270/58.02; 270/58.04; 270/52.18

(58) Field of Search ..... 227/2, 6, 5, 131, 227/151; 270/37, 52.18, 58.04, 58.02, 58.01

(56) References Cited

U.S. PATENT DOCUMENTS 5,229,812 A * 7/1993 Toyama et al. ..... 270/58.08
5,443,249 A * 8/1995 Rizzolo et al. ..... 270/58.08
5,472,181 A * 12/1995 Lowell ..... 270/58.09
5,639,078 A * 6/1997 Mandel et al. ..... 270/58.12
5,642,876 A * 7/1997 Ferrara et al. ..... 270/58.01
5,746,162 A * 5/1998 Hosoi et al. ..... 270/58.08
6,022,011 A * 2/2000 Hirose ..... 270/37
6,315,473 B1 * 11/2001 Slippy ..... 400/578

* cited by examiner

*Primary Examiner*—Rinaldi I. Rada
*Assistant Examiner*—Michelle López
(74) *Attorney, Agent, or Firm*—Tallam I. Nguti

(57) ABSTRACT

A universal and precise stapling assembly is provided and includes (a) a moveable stapling head for driving staples at precise locations through an aligned set of sheets on any one of plural types of alignment apparatus; (b) a drive device coupled to the stapling head for moving the stapling head relative to the any one of plural types of alignment apparatus and the aligned set of aligned sheets on the any one of the plural types of alignment apparatus; (c) sensors for sensing a position of the aligned set of sheets; and (d) a programmable controller connected to the drive device, to the sensors, and to the stapling head, and including calculating capability for precisely calculating a precise staple location responsively to a type of any one of the plural types of alignment apparatus and to the secured position of the aligned set of sheets, thereby reducing staple mislocation due to a tolerance stack up from components of the stapling head and components of any one of the plural types of alignment apparatus.

16 Claims, 2 Drawing Sheets

UNIVERSAL AND PRECISE STAPLING METHOD AND APPARATUS

BACKGROUND OF THE INVENTION

The present invention relates to electrostatographic reproduction machines for producing sets of document copy sheets, and more particularly to a universal and precise stapling method and apparatus for stapling such sets of document copy sheets despite stack-up tolerances of stapling assembly components.

In a typical electrostatographic reproduction machine or toner image reproduction machine, portions of a rotatable photoconductive member in the form of a drum or a belt, are charged sequentially to a substantially uniform potential so as to sensitize the surface thereof. The charged portions of the photoconductive member are exposed to a light image of an original document being reproduced. Exposure of the charged photoconductive member thus selectively dissipates the charges thereon in the exposed areas. Such exposure forms an electrostatic latent image on the photoconductive member that corresponds to the informational areas contained within an original document to be reproduced.

After the electrostatic latent image is formed on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner image is then transferred from the photoconductive member to a copy sheet of paper where the toner particles forming the toner image are heated to permanently affix the toner image to the copy sheet forming a copy of the original image.

A mass of copies of the original image can be formed in this manner. Other copy forming machines of course include printing presses, and the like. With the advent of higher speed and more sophisticated copy producing machines, such as electrostatographic reproduction machines and printing presses, one way of handling such copies has been to provide a finishing device or finisher that includes a stapling assembly that organizes the copies into sets, and binds or staples them. In such a finisher, the copies or copy sheets are collected in collated sets as they are sequentially produced by the machine for binding by a stapling head of the stapling assembly without the interaction of additional devices.

The stapling assembly of such a finisher usually includes a copy sheet alignment apparatus, a moveable stapling head and means for moving the stapling head. The alignment apparatus can be one of two types, namely an edge-alignment type, or a center-alignment type. The stapling head is ordinarily moved back and forth relative to an aligned set of sheet in a cross-process direction and to various positions within the stapling assembly for locating staples, and performing stapling operations, on an aligned set of copy sheets.

The accuracy of the locations of staples from any edge of the aligned set copy is dependent on many factors including the assembly tolerance stack-up of the relevant parts and components of the alignment apparatus and the stapling head. Usually, the staples are specified to be located at predetermined distances from the edge of the aligned set of sheets. However, because of the design tolerances on individual parts and components of the alignment apparatus and the stapling head, the tolerances as well as the stack-up of such tolerances, the actual staple locations achieved can vary significantly from specified locations. The undesirable results can include staples missing some edges partially or completely. This problem is aggravated when a stapling head initially set for an edge-alignment apparatus is used with a center-alignment apparatus.

Conventionally, attempts to avoid such undesirable results and to achieve much more precise location of staples on aligned sets of sheets by mechanical means have typically involved trying to design all the parts and components to tighter and tighter tolerances. This of course is not desirable because it results in relatively more costly and stringent manufacturing control of such parts and components, as well as in much higher cost of manufacturing.

SUMMARY OF THE INVENTION

In accordance with the present invention, there is provided a universal and precise stapling assembly including (a) a moveable stapling head for driving staples at precise locations through an aligned set of sheets on any one of a plural types of alignment apparatus; (b) a drive means coupled to the stapling head for moving the stapling head relative to the any one of plural types of alignment apparatus and the aligned set of aligned sheets on the any one of the plural types of alignment apparatus; (c) sensor means for sensing a position of the aligned set of sheets; and (d) a programmable controller connected to the drive means, to the sensor means, and to the stapling head, and including calculating means for precisely calculating a precise staple location responsively to a type of any one of the plural types of alignment apparatus and to the secured position of the aligned set of sheets, thereby reducing staple mislocation due to a tolerance stack up from components of the stapling head and of any one of the plural types of alignment apparatus.

BRIEF DESCRIPTION OF THE DRAWINGS

In the detailed description of the invention presented below, reference is made to the drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
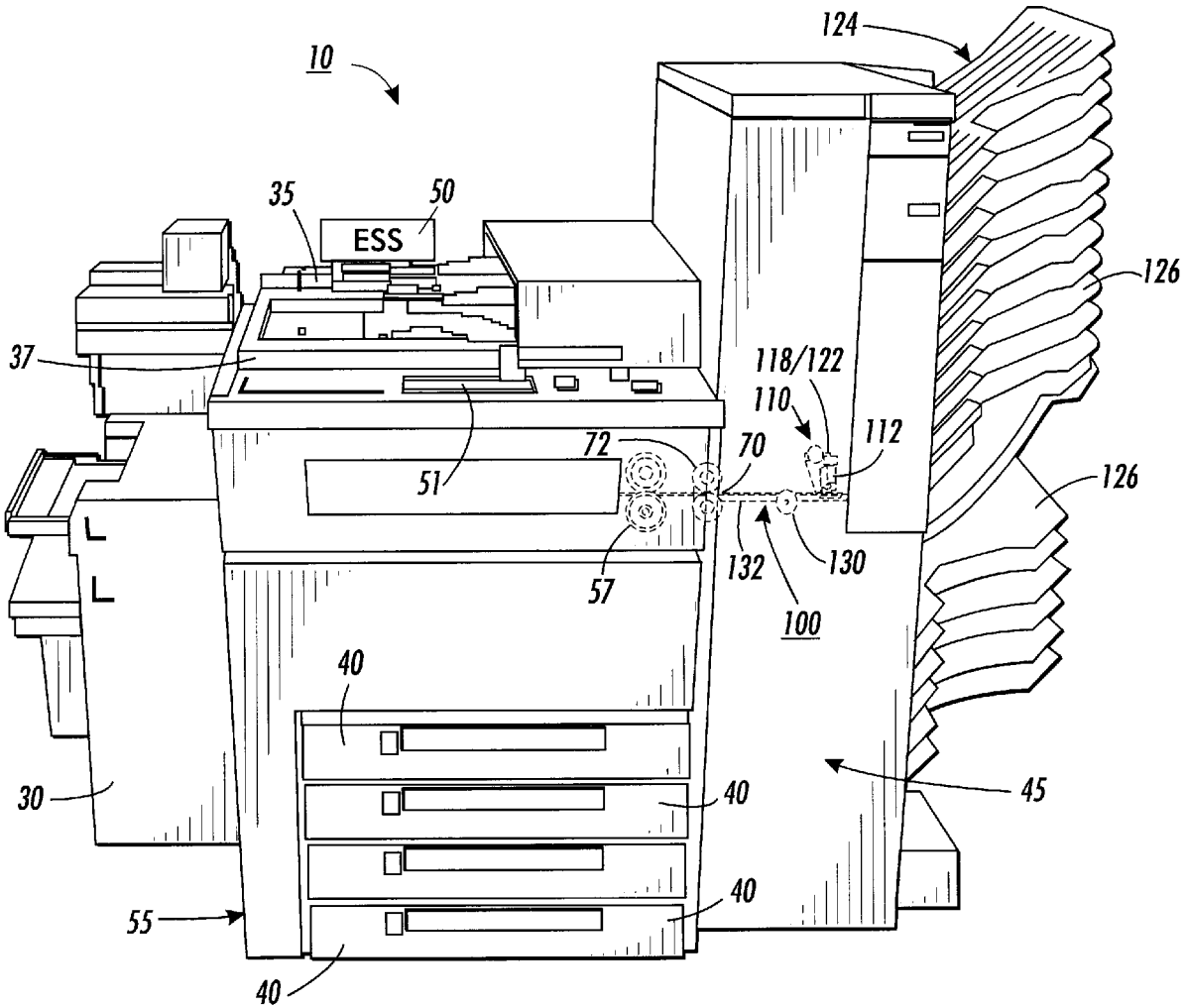
FIG. 1 is an external perspective illustration of an exemplary electrostatographic reproduction machine including a finisher having the universal and precise stapling assembly of the present invention.

Referring now to FIG. 1, an overall construction of a document copy sheet producing machine, such as a digital multi-function reprographic machine, is illustrated generally as 10. As shown, the machine 10 includes a scanning station 35, a printing station 55, and a programmable machine controller or electronic control subsystem (ESS) 50 having a user interface (UI) 51. The machine 10 also includes a finisher 45 that at least includes the universal and precise stapling assembly 100 of the present invention. As shown, the printing station 55 may include a plurality of paper trays 40 that store copy paper or sheets that are fed and used in the printing process to produce the document sheet copies. Additionally, the machine 10 may also include a high capacity feeder 30 which is capable of holding large amounts of paper or sheet stock to be used by the machine.

In a typical scanning function, the operator would utilize the scanning station 30 to scan in the images from the original documents. This scanning station 30 may be a platen type scanner or may include a constant velocity transport system which moves the original documents across a stationary scanning device. Moreover, the scanning station 30 may also include a document handling system which is capable of placing the original documents, automatically, on the glass platen for scanning.

With respect to the printing functions, the printing station 55 would retrieve the proper type and size of copy paper from one of the multiple copy paper trays or from the high capacity feeder, form and transfer the desired toner image onto the retrieved copy paper, fuse the toner image at a fusing station 57 onto such paper, and then output the copy sheet with the fused image thereon to the finisher 45 for further aligning and precise stapling in accordance with the present invention.

The programmable controller or ESS 50 is preferably a self-contained, dedicated mini-computer having a central processor unit (CPU), electronic storage, and the display or user interface (UI) 51. The ESS 50 as such is the control system which with the help of sensors and connections reads, captures, prepares and manages the image data flow between various subsystems of the machine 10. In addition, the ESS 50 is the main multi-tasking processor for operating and controlling all of the other machine subsystems and printing operations. These printing operations include imaging, development, sheet delivery and transfer, and particularly the control mode or algorithm for the universal and precise stapling assembly in accordance with the present invention.

Figure 2:
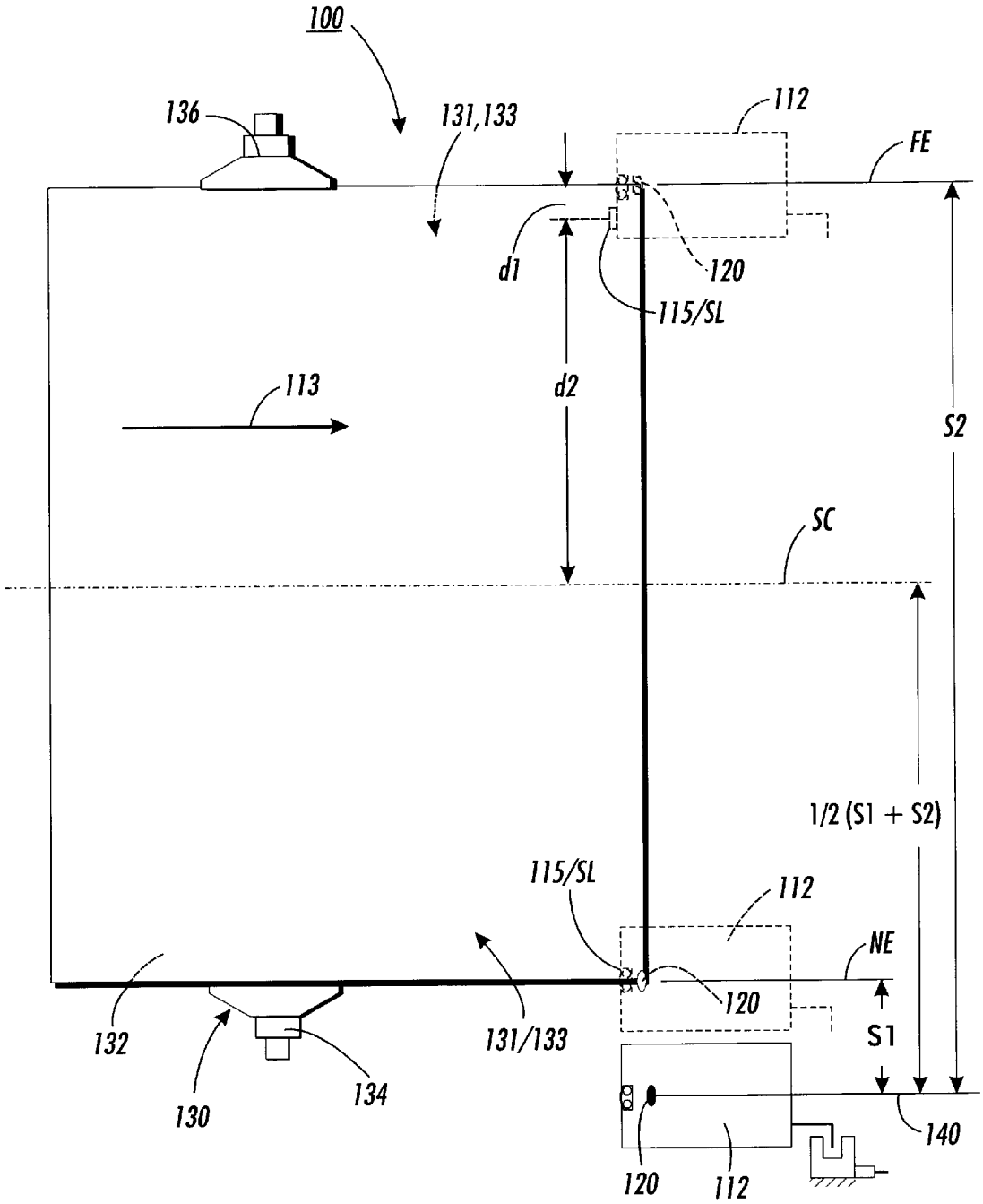
FIG. 2 is a plan view of the stapling assembly of FIG. 1 showing the alignment apparatus and stapling head in accordance with the present invention.

Referring now to FIGS. 1–2, copy sheets exiting the fusing station 57 are transported by transport rollers 72 through an exit slot 70 into the finisher 45, and onto the universal and precise stapling assembly 100 of the present invention. As illustrated, the universal and precise stapling assembly 100 includes a stapling head mechanism 110 and an alignment apparatus 130 having a sheet compiler tray 132 and edge tampers 134, 136. The stapling head mechanism 110 includes a stapling head 112, a sheet sensor 120 and a stepper motor 122 for moving the stapling head 112 across sheets stacked on the sheet compiler tray 132 of the alignment apparatus 130. The sheet sensor 120, the stepper motor 122 and the stapling head 112 are connected to, and are operated by the controller or ESS 50. As further shown, the finisher 45 may also include an output system such as a multi-bin mailbox mechanism 124 consisting of a plurality of bins 126.

As shown, each document copy sheet fed from the fusing station 57, is positioned the sheet compiler tray 132 of the stapling assembly 100. After copy sheets have been collected as above into sets, the sets are now in condition to be further processed, for example by the stapling assembly 100 of the present invention. As pointed out above, the stapling head 112 is moved back and forth in a across the process direction 113 for stapling purposes. The accuracy of staple locations (SL) from the edge of the paper is dependent on many factors. One of the factors is the assembly tolerance stack-up of the relevant parts and components of the stapling assembly 100.

Referring now to FIGS. 1–2, the present invention facilitates stapling of an aligned set of sheets 138 at predetermined location (SL) relative to an edge of the aligned set of sheets, and in such a manner that the accuracy of such a location is not affected by the assembly tolerance stack-up of the relevant parts and components of the stapling assembly 100. In accordance with present invention, the edge tampers 134, 136 are moved against the side edges of a sheet or set of sheets that is placed on the compiler tray 132 for alignment. The alignment apparatus 130 may be a sheet edge-alignment device 131, or it can equally be a sheet center-alignment device 133.

After the aligned set of sheets 138 is held in place by a hold down device (not shown), the stapling head 112 is moved from a home position 140 (which as shown, is located to one side of the aligned set of sheets 138) across the aligned set of sheets to, and beyond, the opposite side of the aligned set of sheets. During this movement of the stapling head 112, the sheet presence sensor 120 located on and at the center of the stapling head 112, senses first the near edge (NE) and then the far edge (FE) of the aligned set of sheets, and the controller 50 records the near edge distance (SNE) as well as the far edge distance (SFE) from the home position 140 in terms of a number of steps of the stepper motor 122. The controller 50 is also programmable with respect to (a) whether the alignment device 131, 133 and the method of sheet alignment is edge-alignment or center-alignment, and (b) specified location distances of the staples from an edge (NE, FE) or from the center SC of the aligned set of sheets 138.

As previously mentioned, the programmable controller is programmed to accept and use input information regarding an operator's selection of which edge of the aligned set of sheets to staple. In the case of a center-alignment device 133, when the edges sensed are SNE and SFE steps from home position 140, then a center SC of the aligned set of sheets 138 can be calculated to be equal to ½ (SNE+SFE) steps of the stepper motor 122 from the home position 140.

Thus for precisely locating staples relative to an edge NE, FE or a center SC, of an aligned set of sheets 138, the universal and precise stapling assembly 100 includes a stapling head mechanism 110, including a moveable stapling head 112 for driving staples at precise staple locations (SL) through an aligned set of sheets 138 located on any one of a plural types of alignment apparatus 130. The universal and precise stapling assembly 100 also includes (i) a drive device 118 coupled to the stapling head 112 for moving the stapling head 112 relative to the alignment apparatus 130 and the aligned set of aligned sheets thereon; (ii) sensor 120 including a sheet presence 120 for sensing a position of the aligned set of sheets 138; and (iii) a programmable controller 50 connected to the drive device 118, to the sheet presence sensor 120, and to the stapling head 112. The programmable controller 50 includes a calculating application for precisely calculating a precise staple location (SL) responsive to a type of alignment apparatus 130 and to the sensed position (SNE, SFE) of the aligned set of sheets 138. In this manner, a risks of staple mislocation due to a tolerance stack up from components of the stapling head 112 as well as those of the type of alignment apparatus 130, are reduced.

The drive device 118 comprises a stepper motor. As pointed out above, the stapling head 112 has a home position 140 and is moveable from the home position 140 across the alignment apparatus 130, and back to the home position 140. The programmed controller 50 is programmable to recognize, and use, a type of alignment apparatus 130 in determining a location for placing staples in the aligned set of sheets 138. The programmable controller 50 is also programmable with, and to use, a desired distance d1 of a located staple 115 from an edge (NE, FE) of the aligned set of sheets 138. In the case of a center-alignment device, it is programmable with, and to use, a desired distance d2 of a located staple 115 from a center SC of the aligned set of sheets 138. As such, the programmable controller 50 can accept and use input information regarding an operator's selection of which edge (NE, FE) of the aligned set of sheets 138 to use for locating the staple 115.

In accordance with an aspect of the present invention, the calculating application of the controller is suitable for calculating the staple location (SL) to be equal to a number of stepper motor steps (SFE) from the home position 140 to the far edge (FE) of the aligned set of sheets 138 minus a pre-programmed desired distance d1 of staples from an edge (NE, FE) of the aligned set of sheets 138.

Similarly, the calculating application of the controller is also suitable for calculating the staple location (SL) to be equal to a number of stepper motor steps (SNE) from the home position 140 to a near edge (NE) of an aligned set of sheets 138 plus a programmed desired distance d1 of staples from an edge (NE, FE) of the aligned set of sheets 138.

In the case of a center-alignment device 133, the calculating application of the controller is also suitable for calculating a center (SC) for the aligned set of sheets 138 such that the center SC is equal to ½ (SNE plus SFE) where SNE is a number of stepper motor steps from the home position 140 to the near edge (NE), and SFE is a number of stepper motor steps from the home position 140 to the far edge (FE). After that, the calculating application of the programmed controller is then suitable for calculating the staple location (SL) to be equal to a number of stepper motor steps (SC) from the home position 140 to the calculated center minus a programmed desired distance d2 of staples from the calculated center.

The sheet presence sensor 120 is mounted on, and for movement with the stapling head 112, and is capable of indicating a start of sheet presence condition, as well as a start of sheet absence condition.

The stapling method of precisely locating a staple on an aligned set of sheets on any one of plural types of sheet alignment apparatus includes (a) programming a programmable controller 50 of a stapling assembly 100 to include and use, type of alignment apparatus 130 information, a stapling head home position information, sheet alignment information, and calculation algorithms; (b) connecting the programmable controller 50 to a stapling head 112 of the stapling assembly 100; (c) sensing a near edge (NE) and a far edge (FE) of the aligned set of sheets 138 relative to a home position 140 of the stapling head 112; (d) measuring distances (SNE, SFE) from the home position 140 to the near edge and the far edge respectively; (e) controllably moving the stapling head 112 relative to the home position 140; (f) calculating a precise staple location (SL) responsively to the measured distances, the type of alignment apparatus 130 information, and the calculation algorithms; and (g) driving a staple 115 at the calculated staple location (SL).

In accordance with the present invention, the entire locational characteristics of the staple locations (SL) are dependent only on the locational characteristics of the aligned set of sheets and the number of calculated motor steps relative to such alignment. As such, staple mislocation effects due to a tolerance stack-up of the parts and components of the sheet alignment device and the stapling head, are minimized. As a result, such parts and components can be designed as well as manufactured with much loser tolerances, thus correspondingly reducing design and manufacturing costs, while still meeting precise staple location requirements for staples on a set of aligned sheets.

As can be seen, there has been provided a universal and precise stapling assembly including (a) a moveable stapling head for driving staples at precise locations through an aligned set of sheets on any one of a plural types of alignment apparatus; (b) a drive means coupled to the stapling head for moving the stapling head relative to the any one of plural types of alignment apparatus and the aligned set of aligned sheets on the any one of the plural types of alignment apparatus; (c) sensor means for sensing a position of the aligned set of sheets; and (d) a programmable controller connected to the drive means, to the sensor means, and to the stapling head, and including calculating means for precisely calculating a precise staple location responsively to a type of any one of the plural types of alignment apparatus and to the secured position of the aligned set of sheets, thereby reducing staple mislocation due to a tolerance stack up from components of the stapling head and of any one of the plural types of alignment apparatus.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A universal and precise stapling assembly comprising:

(a.) a moveable stapling head for driving staples at precise locations through an aligned set of sheets on a given sheet alignment apparatus being one of a sheet-edge type alignment apparatus and a sheet-center type alignment apparatus;

(b.) a drive device coupled to said stapling head for moving said stapling head relative to said given sheet alignment apparatus, and relative to the aligned set of sheets on said given sheet alignment apparatus;

(c.) a sensor for sensing a position of the aligned set of sheets, said sensor comprising a sheet presence sensor, and said sheet presence sensor being mounted on and for movement with said stapling head; and (d.) a programmable controller connected to said drive device, to said sensor, and to said stapling head, said programmable controller including programmed type of sheet alignment apparatus information and calculating means for precisely calculating a precise staple location responsively to said programmed type of sheet alignment apparatus information and to the sensed position of the aligned set of sheets, thereby reducing staple mislocation due to a tolerance stack-up from components of said stapling head and tolerance stack-up from components of said given sheet alignment apparatus.

2. The universal and precise stapling assembly of claim 1, wherein said drive means comprises a stepper motor.

3. The universal and precise stapling assembly of claim 1, wherein said stapling head has a home position and is moveable from said home position across the alignment apparatus and back to said home position.

4. The universal and precise stapling assembly of claim 1, wherein said programmable controller is programmed with, and to use, a desired distance for locating a staple from an edge of the aligned set of sheets.

5. The universal and precise stapling assembly of claim 1, wherein said programmable controller is programmed with, and to use, a desired distance for locating a staple from a center of the aligned set of sheets.

6. The universal and precise stapling assembly of claim 1, wherein said programmable controller accepts and uses input information regarding an operators selection of which edge of the aligned set of sheets to staple.

7. The universal and precise stapling assembly of claim 1, wherein said calculating means is suitable for calculating the staple location (SL) to be equal to a number of stepper motor steps (SFE) from said home position to a sheet far edge of an aligned set of sheets minus a pre-programmed desired distance for locating staples from an edge of the aligned set of sheets.

8. The universal and precise stapling assembly of claim 1, wherein said calculating means is suitable for calculating the staple location (SL) to be equal to a number of stepper motor steps (SNE) from said home position to a near edge of an aligned set of sheets plus a programmed desired distance for locating staples from an edge of the aligned set of sheets.

9. The universal and precise stapling assembly of claim 1, wherein, when the alignment apparatus is a sheet center aligning device, said calculating means is suitable for calculating a center for the aligned set of sheets to be equal to ½ (SNE+SFE) where SNE is a number of stepper motor steps from said home position to said near edge (NE), and SFE is a number of stepper motor steps from said home position to said far edge (FE).

10. The universal and precise stapling assembly of claim 1, wherein said sheet presence sensor is capable of indicating a start of sheet presence condition and a start of sheet absence condition.

11. The universal and precise stapling assembly of claim 9, wherein said programmable controller is programmed for calculating the staple location (SL) to be equal to a number of stepper motor steps from said home position to said calculated center minus a programmed desired distance for locating staples from said calculated center.

12. A method of a stapling assembly for precisely locating a staple on an aligned set of sheets on a given sheet alignment apparatus being one of either a sheet-edge type alignment apparatus and a sheet-center type alignment apparatus, the method comprising:

a. programming a programmable controller of the stapling assembly to include and use, type of alignment apparatus information, stapling head home position, aligned set of sheet information and calculation algorithms;

b. connecting the programmable controller to a stapling head of the stapling assembly;

c. sensing a near edge and a far edge of the aligned set of sheets relative to a home position of the stapling head, said sensing comprising moving a sensor from a home position across the aligned set of sheets;

d. measuring distances from the home position to the near edge and the far edge respectively;

e. controllably moving the stapling head relative to the home position;

f. calculating a precise staple location responsively to the measured distances, the type of alignment apparatus information, and the calculation algorithms, thereby eliminating the staple mislocation effects of component tolerance stack-up; and g. driving a staple at the calculated staple location.

13. The method of claim 12, wherein said step of calculating comprises calculating the staple location (SL) to be equal to a number of stepper motor steps from said home position to said calculated center minus a programmed desired distance for locating staples from said calculated center.

14. The method of claim 12, wherein said step of calculating comprises calculating a center for the aligned set of sheets to be equal to ½ (SNE+SFE) where SNE is a number of stepper motor steps from said home position to said near edge (NE), and SFE is a number of stepper motor steps from said home position to said far edge (FE).

15. The method of claim 12, wherein said step of calculating comprises calculating the staple location (SL) to be equal to a number of stepper motor steps (SNE) from said home position to a near edge of an aligned set of sheets plus a programmed desired distance for locating staples from an edge of the aligned set of sheets.

16. The method of claim 12, wherein said step of calculating comprises calculating the staple location (SL) to be equal to a number of stepper motor steps (SFE) from said home position to a sheet far edge of an aligned set of sheets minus a pre-programmed desired distance for locating staples from an edge of the aligned set of sheets.

* * * * *